US007637630B2

(12) United States Patent
Wilcox et al.

(10) Patent No.: US 7,637,630 B2
(45) Date of Patent: Dec. 29, 2009

(54) INTEGRATED SHIELD-GASKET MEMBER IN LED APPARATUS

(75) Inventors: Kurt S. Wilcox, Libertyville, IL (US); Alan J. Ruud, Racine, WI (US)

(73) Assignee: Ruud Lighting, Inc., Racine, WI (US)

( * ) Notice: Subject to any disclaimer, the term of this patent is extended or adjusted under 35 U.S.C. 154(b) by 3 days.

(21) Appl. No.: 12/107,138

(22) Filed: Apr. 22, 2008

(65) Prior Publication Data

US 2009/0262532 A1 Oct. 22, 2009

(51) Int. Cl.
*F21V 29/00* (2006.01)

(52) U.S. Cl. ..... 362/267; 362/158; 362/645

(58) Field of Classification Search ..... 362/158, 362/645, 267, 227, 238, 800, 612
See application file for complete search history.

(56) References Cited

U.S. PATENT DOCUMENTS

| | | | |
|---|---|---|---|
| 4,254,453 | A | 3/1981 | Mouyard et al. |
| 5,066,889 | A | 11/1991 | Edwards |
| 5,274,250 | A | 12/1993 | Miyake et al. |
| 5,711,890 | A | 1/1998 | Hawkins et al. |
| 5,796,154 | A | 8/1998 | Sano et al. |
| 5,848,839 | A | 12/1998 | Savage, Jr. |
| 5,984,494 | A | 11/1999 | Chapman et al. |
| 6,325,524 | B1 | 12/2001 | Weber et al. |
| 6,414,343 | B1 | 7/2002 | Kondo et al. |
| 6,630,736 | B1 | 10/2003 | Ignaut |
| 6,635,911 | B2 | 10/2003 | Maruyama |
| 6,635,941 | B2 | 10/2003 | Suda |
| 6,730,940 | B1 | 5/2004 | Steranka et al. |
| 6,837,605 | B2 | 1/2005 | Reill |
| 6,876,008 | B2 | 4/2005 | Bhat et al. |
| 6,893,941 | B2 | 5/2005 | Suda |
| 6,969,946 | B2 | 11/2005 | Steranka et al. |
| 6,972,439 | B1 | 12/2005 | Kim et al. |
| 7,009,213 | B2 | 3/2006 | Camras et al. |
| 7,019,334 | B2 | 3/2006 | Yatsuda et al. |
| 7,078,258 | B2 | 7/2006 | Sakoh et al. |
| 7,080,932 | B2 | 7/2006 | Keuper |
| 7,102,185 | B2 | 9/2006 | Nichols et al. |
| 7,141,825 | B2 | 11/2006 | Horio et al. |
| 7,176,070 | B2 | 2/2007 | Lee et al. |
| 7,182,480 | B2 | 2/2007 | Kan |
| 7,281,818 | B2 | 10/2007 | You et al. |
| 2004/0052077 | A1 | 3/2004 | Shih |
| 2004/0156209 | A1 | 8/2004 | Ishida |
| 2004/0160782 | A1 * | 8/2004 | Zimmermann et al. ..... 362/488 |
| 2005/0013139 | A1 * | 1/2005 | Sugihara et al. ..... 362/490 |
| 2006/0158080 | A1 | 7/2006 | Nakano et al. |
| 2006/0169878 | A1 | 8/2006 | Kasano et al. |

(Continued)

*Primary Examiner*—Jacob Y Choi
(74) *Attorney, Agent, or Firm*—Jansson Shupe & Munger Ltd.

(57) ABSTRACT

An LED apparatus for illumination toward a preferential side in a downward and outward direction including a shield-gasket member in the form of a layer positioned over LED packages and secondary lens members. The shield-gasket member has a shield portion and a substantially planar gasket portion thereabout. In preferred embodiments the shield portion extends over a part of the lens portion of the secondary lens member. A cover preferably secures the shield-gasket member with respect to the secondary lens member, the primary lens and the LED package, the shield-gasket member is preferably sandwiched between the cover and the flange of the secondary lens member.

21 Claims, 13 Drawing Sheets

U.S. PATENT DOCUMENTS

2006/0175626 A1 8/2006 Wall, Jr.
2006/0256573 A1* 11/2006 Pan ..... 362/542
2007/0070625 A1 3/2007 Bang
2007/0097684 A1 5/2007 Obara et al.
2007/0189005 A1* 8/2007 Chapman ..... 362/157
2007/0285915 A1* 12/2007 Rosenau et al. ..... 362/101
2008/0266852 A1* 10/2008 Valerio et al. ..... 362/240
2009/0003009 A1* 1/2009 Tessnow et al. ..... 362/487

* cited by examiner

INTEGRATED SHIELD-GASKET MEMBER IN LED APPARATUS

FIELD OF THE INVENTION

The invention relates generally to the field of lighting systems and, more particularly, to apparatus for utilizing LED (light-emitting diode) sources for illuminating areas with a predefined pattern of light intensity toward a preferential side and to accommodate LED lens(es) movement and provide a weather-proof seal.

BACKGROUND OF THE INVENTION

There is a continuing need for lighting apparatus which is low-cost and energy efficient. LEDs provide light sources which are energy efficient and advances in LED technology are providing even greater such efficiencies. One advantage of using LEDs as light sources is simply that the smaller size of such sources translate into lower material usage within fixtures containing such sources, thus yielding the attendant cost-efficiency.

Preferred performance requirements for lighting systems for various uses involve freedom of "light spillage" into areas not intended to be lit. For example, it is preferred that roadway and parking lot lighting systems have excellent light distribution over areas which are to be lighted, but neighboring regions are as free of light as possible. More specifically, there is a need to be able to direct light in a downward and preferential lateral direction while avoiding so-called trespass lighting on neighboring property, while providing lighting to the roadways or parking lots. Satisfying such concerns can be difficult when LEDs are used as light sources, particularly given the fact that in such cases many LEDs are used in individual fixtures.

Various LED lighting fixtures with either light shielding or gasket layers have been developed. Examples of such prior art fixtures are those disclosed in the following United States patents: U.S. Pat. No. 7,019,334 (Yatsudia, et al), U.S. Pat. No. 6,972,439 (Kim, et al.), Patent Publication Nos: US 2006/0175626 (Wall Jr.), US 2006/0158080 (Nakano et al.) and patent application Ser. No. 11/743,961 (Wilcox, et al.) and Ser. No. 11/744,807 (Wilcox, et al.).

LED fixtures in the prior art having shields and/or gasket layers have certain shortcomings and disadvantages to which this invention is addressed. In particular, there is a need for an improved LED light fixture with a directional shield that facilitates accurate manufacture while having an improved effectiveness in light distribution, including avoidance of light distribution to a non-preferential side. It would be desirable that an LED light fixture with directional shielding which is cost-effective in manufacture be able to provide a high level of output for lighting large areas in a preferential direction while minimizing light in a non-preferential direction. Protection against various environmental factors is also rendered difficult for LED general illumination products which necessarily utilize a large number of LEDs—sometimes plural LED modules with each module having many LED packages thereon.

OBJECTS OF THE INVENTION

It is an object of this invention, to provide an improved LED lighting apparatus with directional shielding which overcomes certain problems and shortcoming of the prior art including those referred to above.

Another object of this invention is to provide an improved LED lighting apparatus which by its nature facilitates accurate manufacture, including of multi-LED fixtures.

Another object of this invention is to provide an improved LED lighting apparatus having the above advantages and with improved effectiveness in light distribution, including avoidance of light distribution to a non-preferential side.

Another object of this invention is to provide an improved LED lighting apparatus which is particularly adaptable for LED fixtures providing a high level of light output for lighting of large areas such as roadways and parking lots.

Another object of this invention is to provide an improved LED lighting apparatus having the above advantages which directs light using a shield in the above fashion in a cost-effective manner.

Yet another object of the invention is to provide an improved LED apparatus protected against various environmental factors.

These and other objects of the invention will be apparent from the following descriptions and the drawings.

SUMMARY OF THE INVENTION

This invention is an LED apparatus for improved illumination toward a preferential side in a downward and outward direction, for accommodating LED lens(es) movement and for providing a weather-proof seal. The apparatus is of the type including a mounting board, an LED package thereon with a primary lens having a central axis and a secondary lens member over the primary lens which establishes a light path therebetween. The improved apparatus of this invention includes all integrated shield-gasket member in the form of a layer which is positioned over the mounting board, LED package and secondary lens member, the shield-gasket member having a shield portion and a substantially planar gasket portion thereabout.

In certain preferred embodiments the shield member has a shield-member aperture aligned with the light path and the shield portion borders the shield-member aperture. In highly preferred embodiments the shield portion is of a substantially annular shape and the substantially annular shield portion includes at least one gap to facilitate drainage of water.

It is most preferred that the secondary lens member includes a lens portion and a flange thereabout and the shield portion extends over a part of the lens portion of the secondary lens member. It is highly desirable that the shield member has a shield-member aperture aligned with the light path and the shield portion borders the shield-member aperture.

Preferred embodiments include a cover which secures the shield member with respect to the secondary lens member, the primary lens and the LED package. The cover has an opening aligned with the light path.

Preferred embodiments have the shield-gasket member sandwiched between the cover and the flange of the secondary lens member. Preferably the flange of the secondary lens member is against the mounting board. The sandwiching is of the gasket portion of the shield-gasket member and of the flange of the secondary lens member when the cover is secured in place. It is most preferred that the shield portion has a reflective surface facing the secondary lens.

In highly preferred embodiments, the LED packages, secondary lens member and shield portion are a plurality of LED packages, secondary lens members and shield portions. Preferably the LED packages are spaced from one another on the mounting board. It is highly preferred that each secondary lens member is positioned over the primary lens of a corresponding LED package, each primary-lens/secondary-lens-member pair establishes a light path and has a central axis. Also preferred is an embodiment with a plurality of shield portions of the shield-gasket member. Each shield portion is positioned partially over each primary-lens/secondary-lens-member pair thereby to intercept a portion of the light emitted from the corresponding LED package.

The LED apparatus for illumination toward a preferential side in a downward and outward direction, in some embodiments, may include a mounting board and an LED package thereon with a primary lens which has a central axis. The improvement comprises a shield-gasket member in the form of a layer positioned over the mounting board and an LED package. The shield-gasket member has a shield portion and a substantially planar gasket portion thereabout.

The term "downward" is used herein for convenience in describing the invention and aspects thereof, but does not in any way mandate usage of the apparatus in any orientation. In other words, "downward" is not limited by the direction of gravity. Thus, if a light fixture incorporating the inventive light-directing LED apparatus disclosed herein is oriented upward rather than downward, or in some laterally-oriented direction, the term "downward" subsumes such meanings. The term "downward" has been used since one important application for the inventive apparatus is the lighting of ground surfaces from vertical light poles. Note that the figures primarily shown such "downward" direction as generally upward since visualization of the compound outer lens surface of the secondary lens in perspective is best viewed for clarity in such orientation.

The term "LED package" as used herein means an assembly including a base, at least one LED (sometimes referred to as "die") on the base, and a primary lens over the die. One or more, typically several, LED packages are arranged on a mounting board in forming that is referred to as an "LED module." One or more LED modules are used as the light source for various innovative lighting fixtures.

The inventive apparatus will most typically be used in applications when a multiplicity of such devices are arranged on what is referred to as an LED module, one or more of which are used within a lighting fixture to achieve desired illumination. Roadway and parking lot lighting are such applications, although there are a great many other applications for such devices.

BRIEF DESCRIPTION OF THE DRAWINGS

The drawings illustrate a preferred embodiment including the above-noted characteristics and features of the invention. The invention will be readily understood from the descriptions and drawings. In the drawings.

DETAILED DESCRIPTION OF PREFERRED EMBODIMENTS

Figure 1:
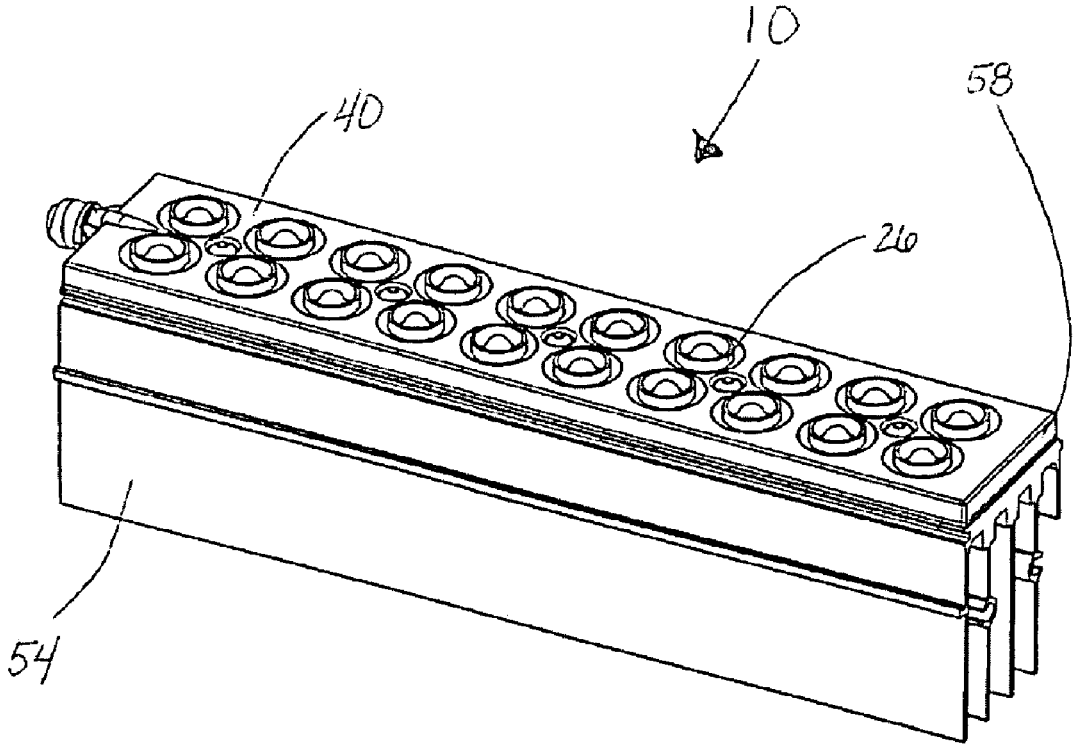
FIG. 1 is a perspective view of a LED lighting apparatus in accordance with this invention, the LED lighting apparatus being a portion of a lighting fixture.
Figure 2:
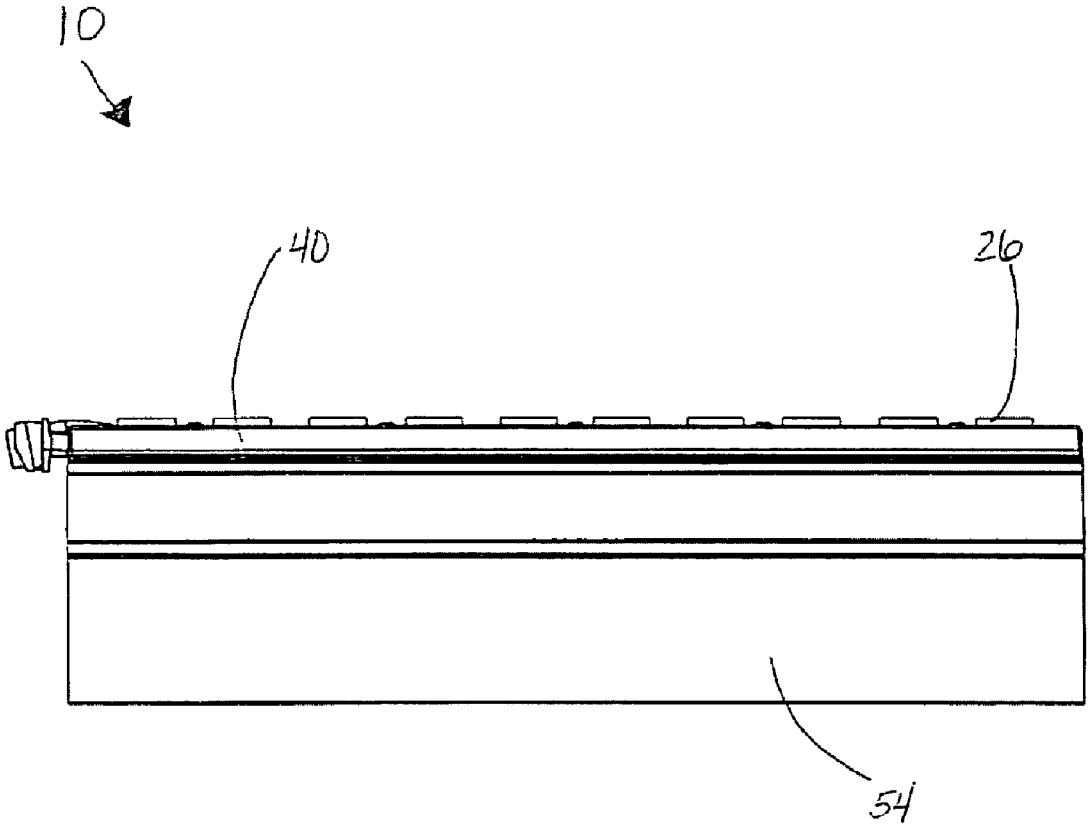
FIG. 2 is a side elevation of the apparatus of FIG. 1.

FIGS. 1-7, 9 and 13 illustrate an LED apparatus 10 for illumination toward a preferential side 36 in a downward direction 48 and outward direction 49 and for accommodating LED lens(es) 16, 20 movement and providing a weatherproof seal. LED apparatus 10 includes a mounting board 12, LED package 14 thereon with primary lens 16 having central axis 18, and secondary lens member 20 over primary lens 16 and establishing light path 22 therebetween. Mounting board 12 is connected to heat sink 54 as shown in FIGS. 1-6. One or more, typically several, LED packages 14 are arranged on a mounting board 12 to form what is referred to as an LED module 58 as illustrated in FIG. 1. One or more LED modules 58 are used as the light source for various innovative lighting fixtures.

Figure 3:
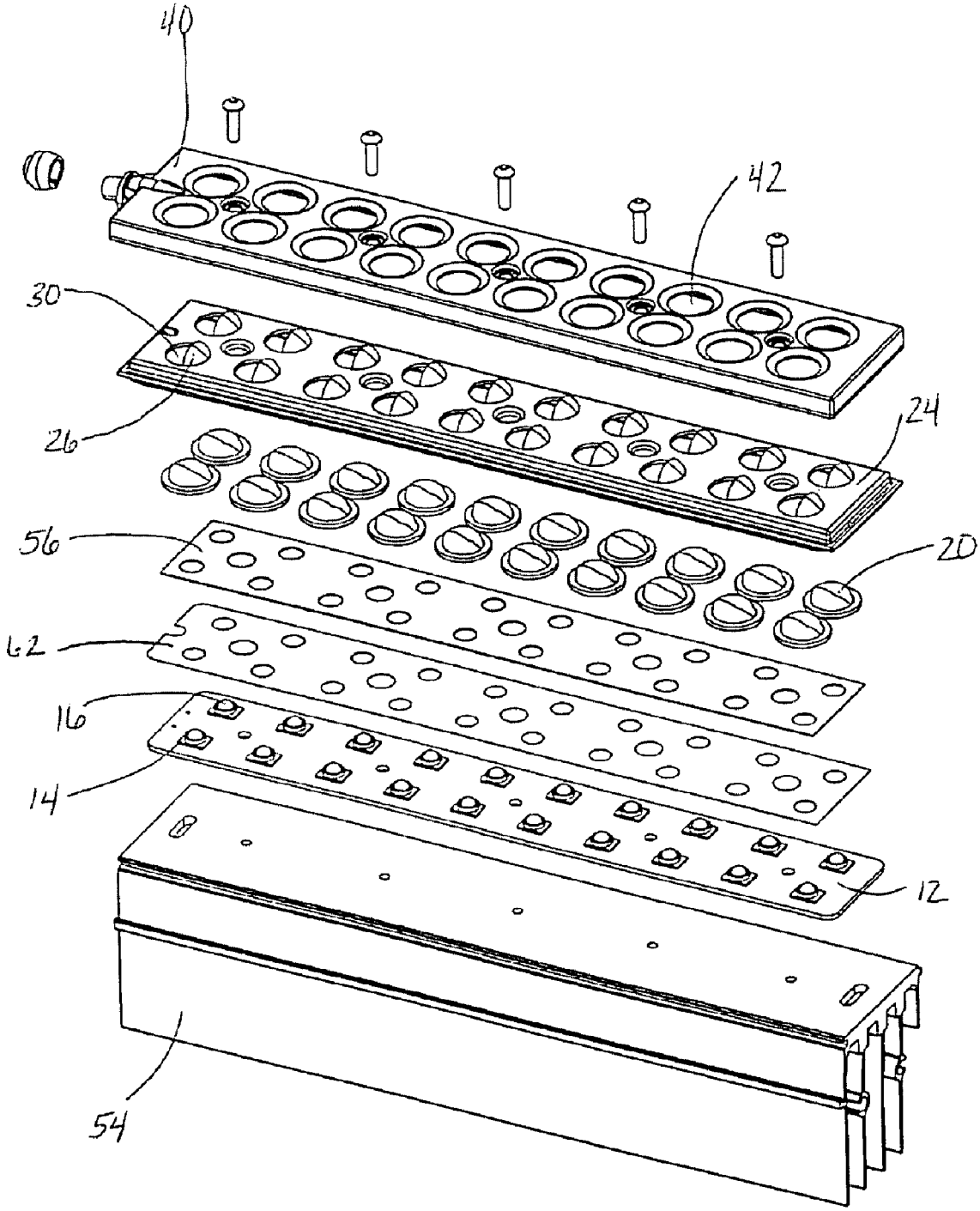
FIG. 3 is an exploded perspective view of a lighting apparatus of FIG. 1.
Figure 4:
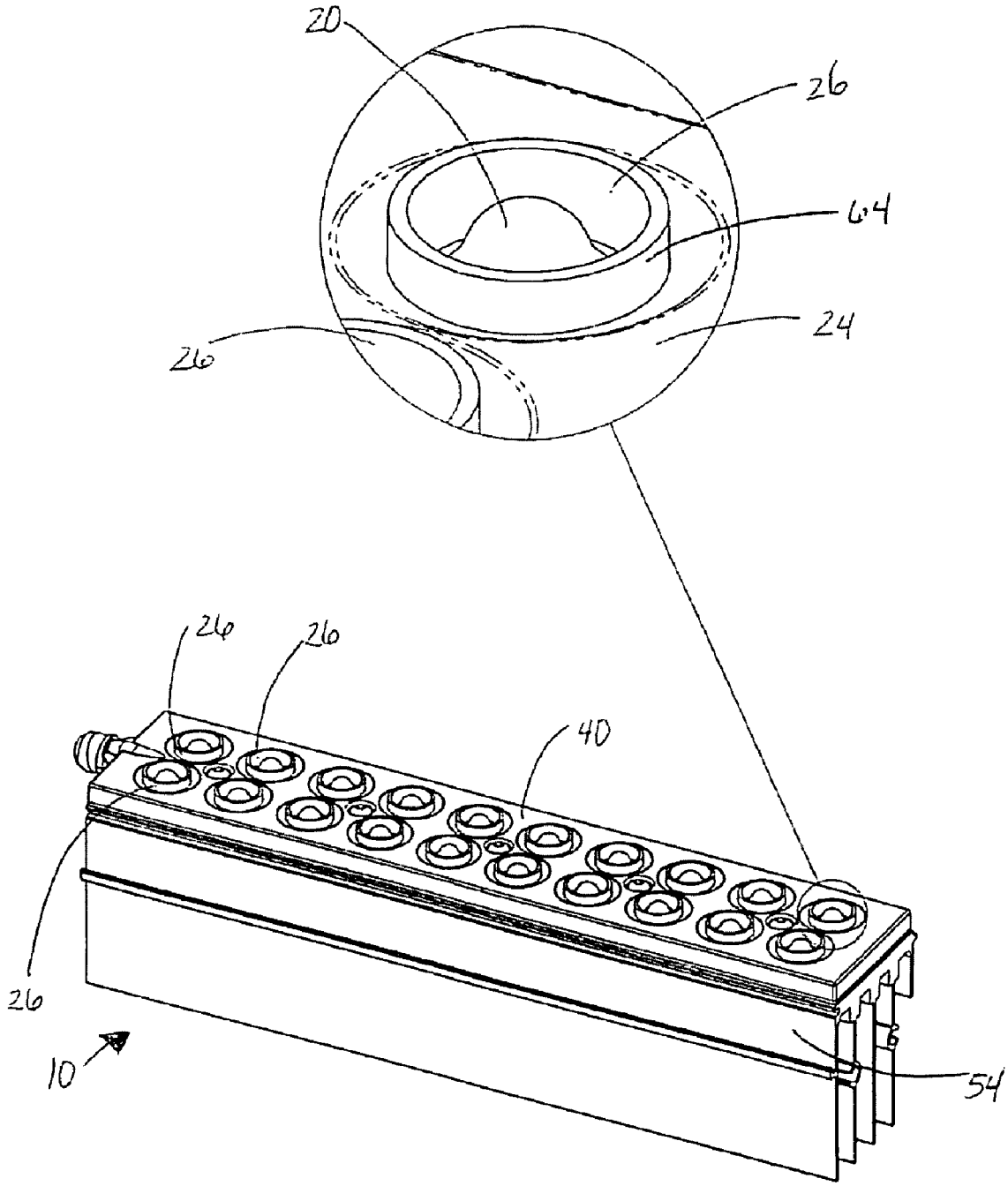
FIG. 4 is a front elevation with an enlarged portion of the apparatus of FIG. 1.
Figure 8:
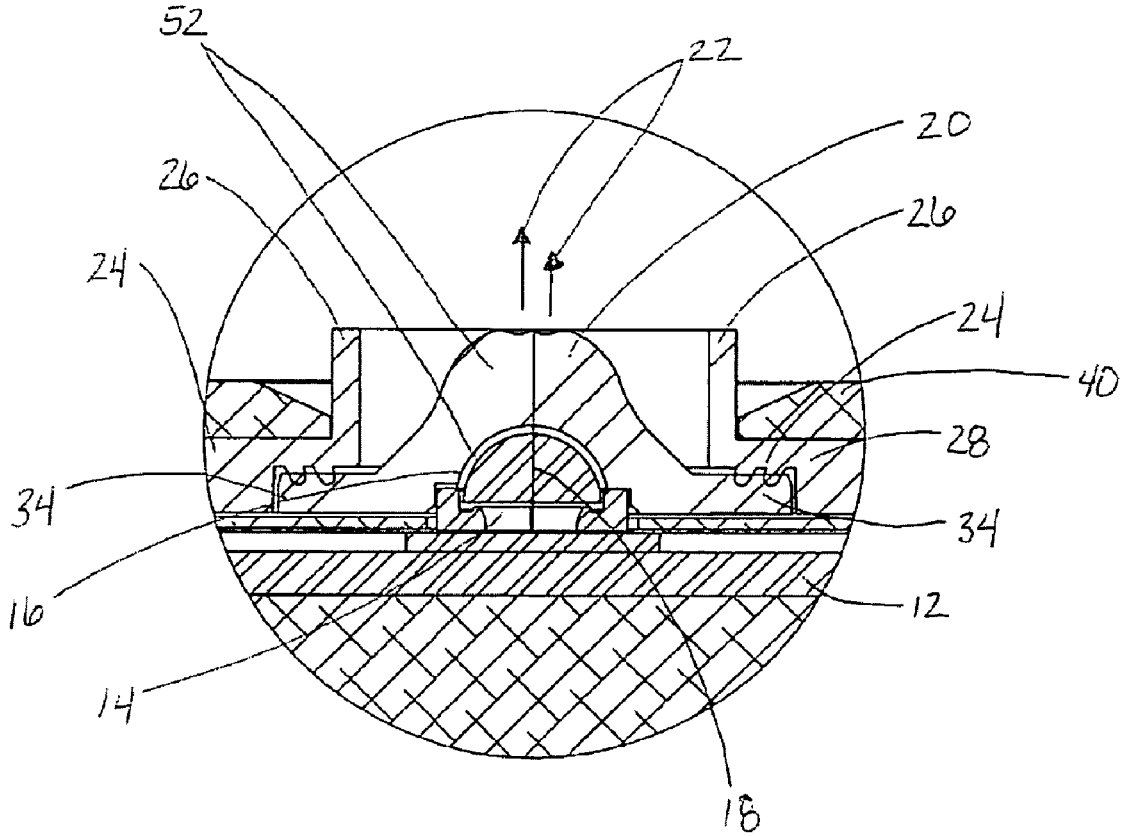
FIG. 8 is a sectional view taken along section A-A as indicated in FIG. 7.
Figure 9:
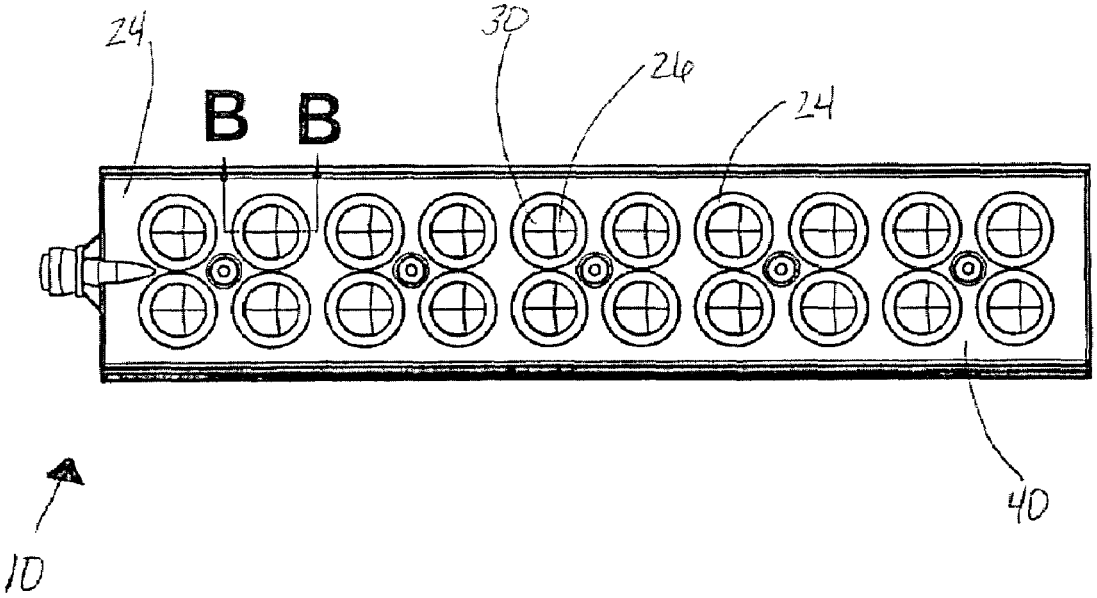
FIG. 9 is a top view of the lighting apparatus of FIG. 1.
Figure 10:
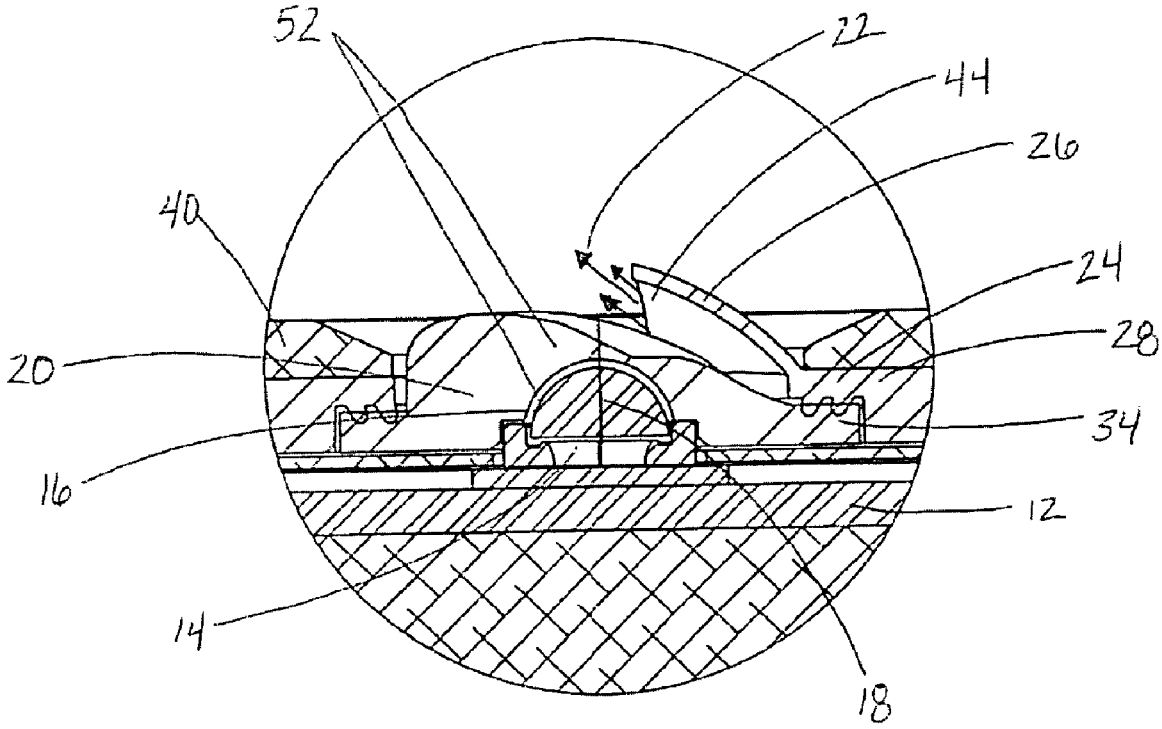
FIG. 10 is a sectional view taken along section B-B as indicated in FIG. 9.

As shown in FIG. 3 shield member 24, in the form of a layer, is positioned over mounting board 12, LED package 14 and secondary lens member 20. Shield-gasket member 24 has shield portion 26 and a substantially planar gasket portion 28 thereabout as seen in FIGS. 3, 5-6, 8 and 10. FIGS. 8-10 illustrate that shield-gasket member 24 has a shield-member aperture 30 aligned with light path 22 and shield portion 26 borders shield-member aperture 30.

Figure 11:
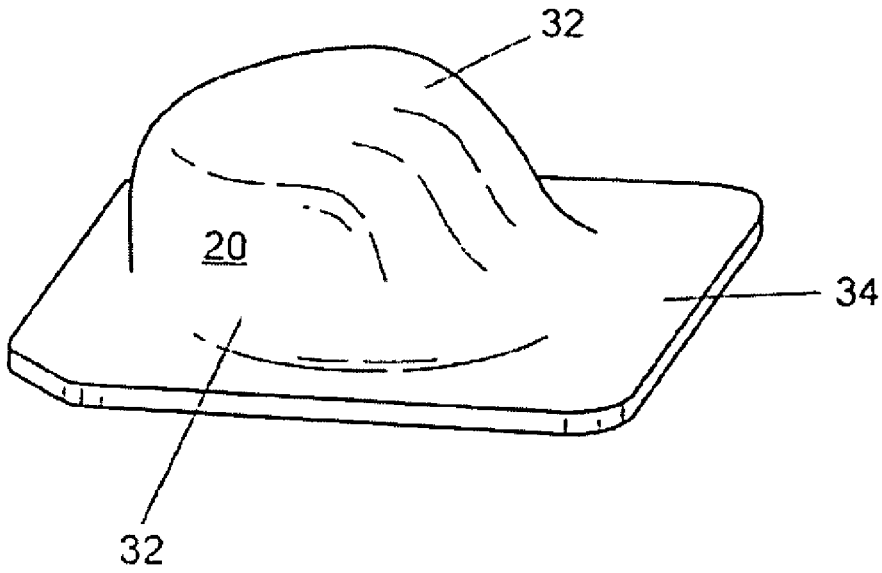
FIGS. 11-12 are perspective views of one of the secondary lenses of the apparatus of FIG. 1, primarily illustrating the outer lens surface of the secondary lens.
Figure 12:
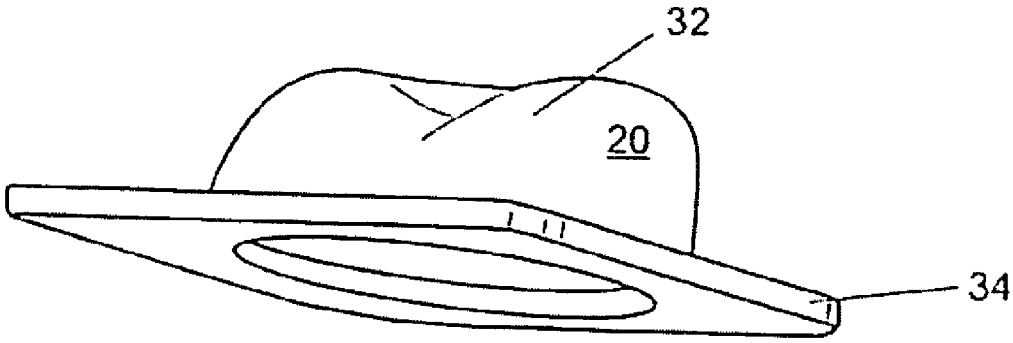
Figure 13:
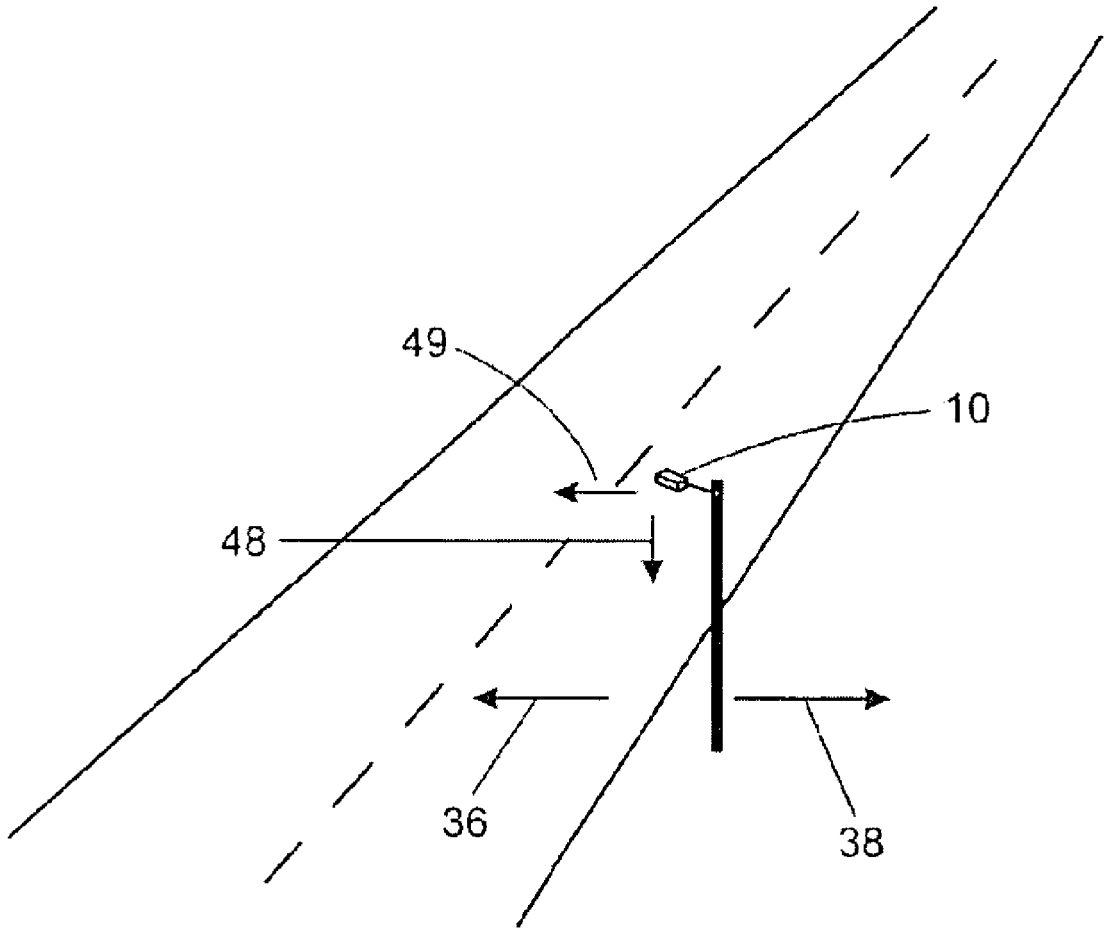
FIG. 13 is a schematic perspective representation of a light pole mounting a lighting fixture including the inventive LED apparatus therein; the pole is positioned along the side of a roadway.
Figure 14:
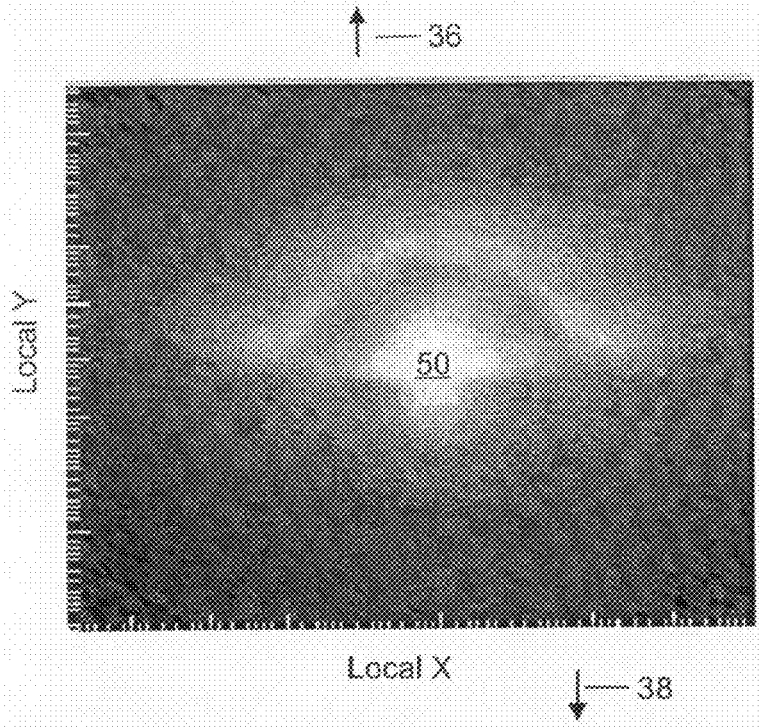
FIG. 14 is a two-dimensional illumination intensity distribution of a lighting fixture such as in FIG. 13 having lighting apparatus as described but without the shielding layer. It does not represent the invention, but is not prior art.
Figure 15:
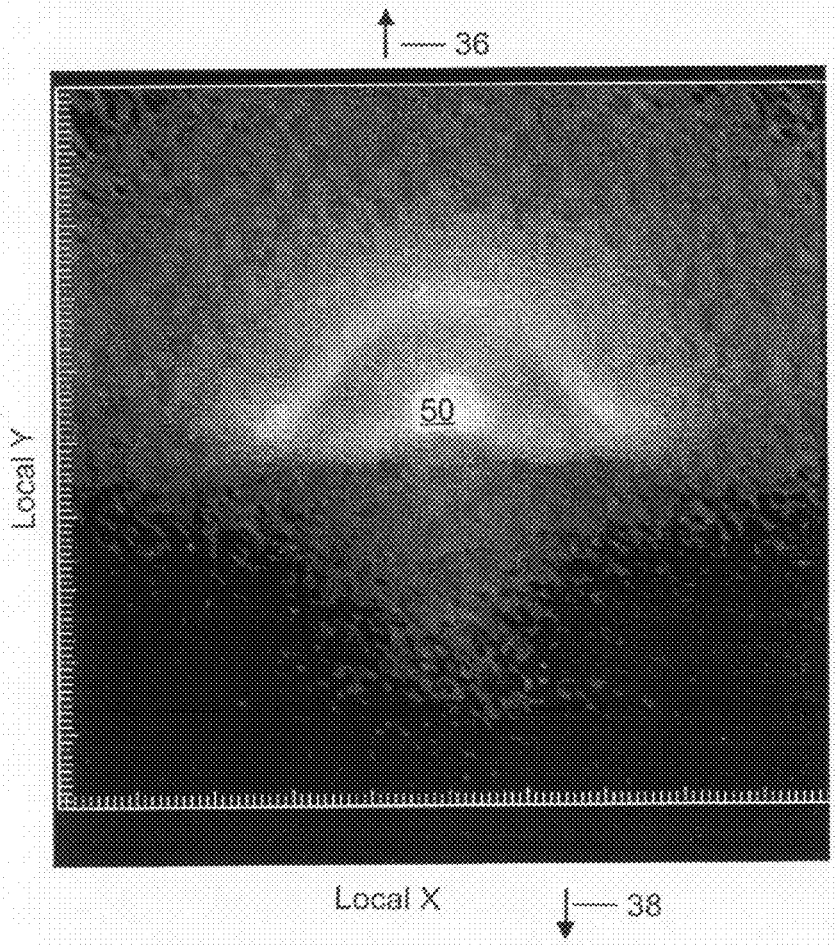
FIG. 15 is a two-dimensional illumination intensity distribution of a lighting fixture such as in FIG. 13 having lighting apparatus as described with the shielding layer.

As shown in FIGS. 11 and 12, secondary lens 20 includes a lens portion 32 which is substantially transparent and a flange 34 portion thereabout. Lens portions 32 is adjacent to flange portion 34 as illustrated in FIGS. 11 and 12. Shield portion 26 can extend over a part of lens portion 32 of secondary lens member 20 as illustrated in FIG. 10 As seen in FIG. 10 shield portion 26 blocks a portion of the light path 22. Secondary lens member 20 is asymmetrical and has an illumination pattern 50 with a preferential side 36 and a non-preferential side 38 as shown in FIGS. 13-15. Shield portion 26 is positioned to intercept light on non-preferential side 38.

FIG. 8 illustrates shield portion 26 which is positioned to block a portion of light path 22 (shield portion 26 intercepts light which is located on the sides of light path 22) and results in light path 22 being in the form of a beam of light.

In FIGS. 13-15, secondary lens 20 defines preferential side as indicated by reference number 36. FIGS. 13-15 also indicate, by reference number 38, the direction toward the opposite, non-preferential side 38.

FIG. 14-15 illustrate a two-dimensional illumination intensity distribution 50 for an embodiment containing an LED package 14, a single primary lens 16 and a single secondary lens 20. Pattern 50 in FIGS. 14-15 was generated using optical ray-tracing software to simulate the illumination intensity emanating from LED apparatus 10.

The brightness of illumination pattern 50 in FIG. 15 illustrates the relative intensity distribution using a shield-gasket member layer 24, demonstrating that a very large percentage of the light emanating from apparatus 10 is redirected toward the preferential side 36 by shield/gasket member layer 24 of apparatus 10 and only a small amount of trespass light on the non-preferential side 38. FIG. 14 illustrates the relative intensity distribution without the shield-gasket member layer 24 present, demonstrating that light is not blocked from the apparatus 10 resulting in a large amount of trespass light on the non-preferential side 38.

FIGS. 1-7 and 9 illustrate that cover 40 secures shield member 24 with respect to secondary lens member 20, primary lens 16 and LED package 14. Cover 40 has an opening 42 aligned with light path 22 as shown in FIG. 3. Shield-gasket member 24 is sandwiched between cover 40 and flange 34 of secondary lens member 20 as illustrated in FIG. 3.

As illustrated in FIG. 3 when cover 40 is secured in place the sandwiching is of the gasket portion 28 of shield-gasket member 24 and of flange 34 of secondary lens member 20. In certain embodiments, flange 34 of secondary lens member 20 is sandwiched against mounting board 12.

Gasket portion 28 of shield-gasket layer 24 is against secondary lens member 20 in position other than in light path 22. Gasket portion 28 is yieldingly constraining secondary lens member 20 and accommodating secondary lens member 20 movement caused by primary lens 16 thermal expansion during operation.

Shield-gasket layer 24 has a plurality of shield member apertures 30. Preferably the gasket portion 28 is made from closed-cell silicone which is soft but solid silicone that is not porous. Gasket portion 28 may also be made from any non-porous material which may be tailored for gasket use. Each shield-gasket layer 24 can have a plurality of shield members 26 on a single gasket portion 28 as illustrated in FIG. 3.

Thermal expansion of primary lens 16 results in abutment of lenses and displacement of secondary lens 20. Gasket portion 28 permits the displacement while holding secondary lens 20 in place over primary lens 16.

LED apparatus 10 can consist of only one LED package 14 on a mounting board 12 with a corresponding primary lens 16, secondary lens member 20 and shield-gasket member 24 or it can consist of plurality of LED packages 14 on mounting board 12 with corresponding primary lenses 16, secondary lens members 20, shield portions 26 and a shield-gasket member 24.

In some embodiments, as shown in FIG. 3, a plurality of LED packages 14 are spaced from one another on the mounting board 12. A plurality of secondary lens members 20 are also present in certain embodiments as illustrated in FIG. 3. Each secondary lens member 20 is positioned over the primary lens 16 of a corresponding LED package 14. Each primary-lens/secondary-lens-member pair 52 establishes a light path 22 and has a central axis 18 as shown in FIGS. 8 and 10.

Figure 5:
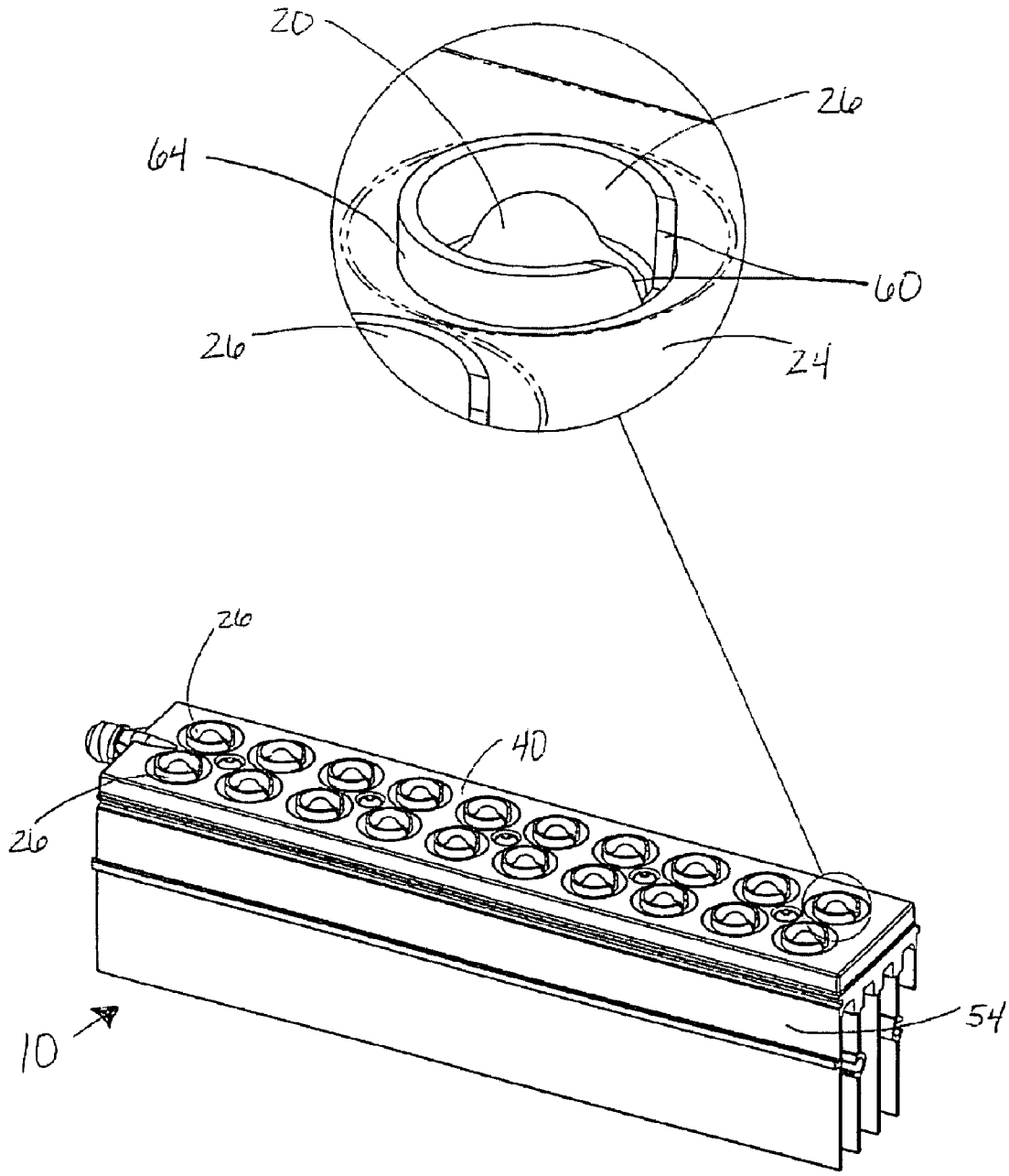
FIG. 5 is a front elevation with an enlarged portion of the apparatus of FIG. 1.
Figure 6:
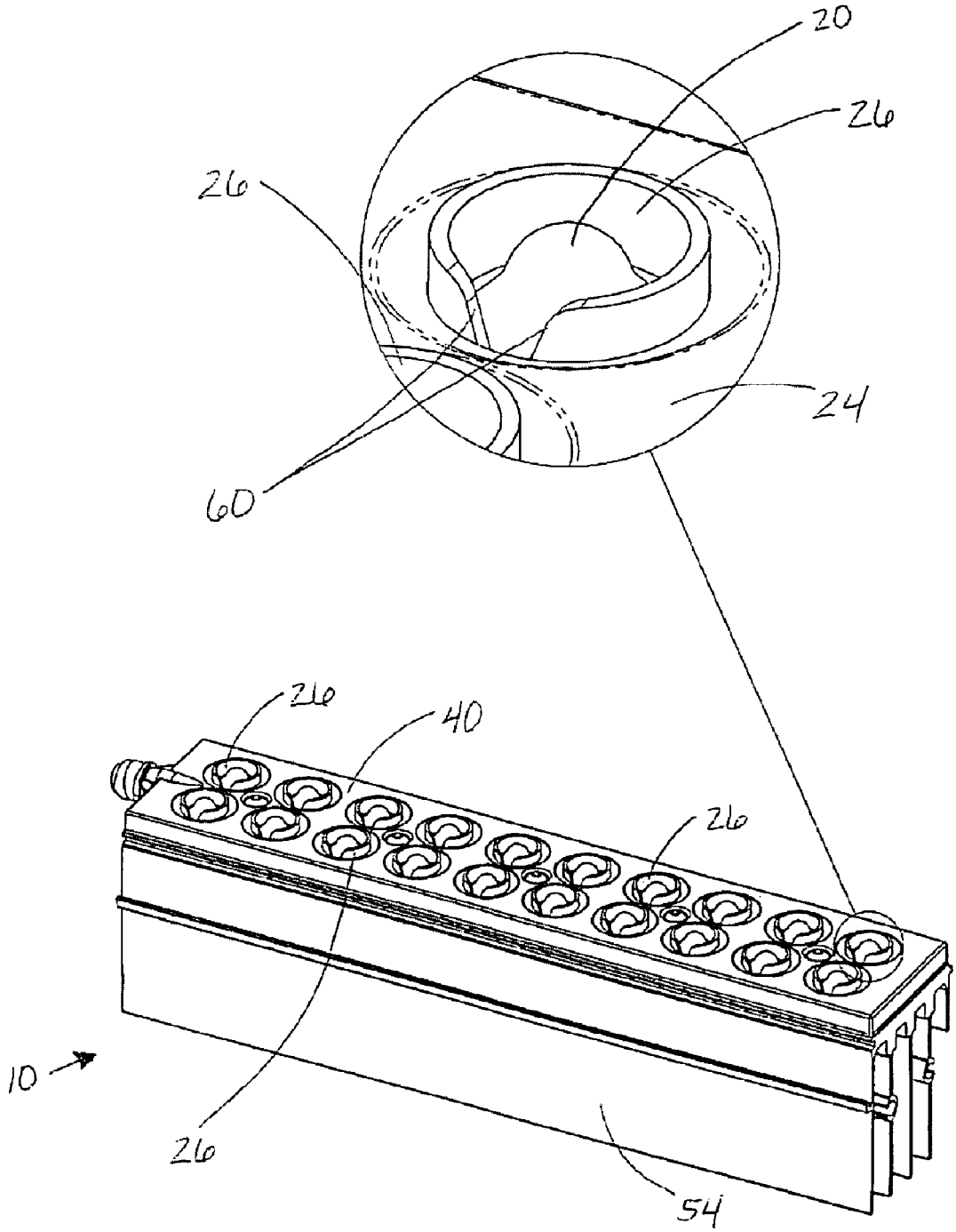
FIG. 6 is a front elevation with an enlarged portion of the apparatus of FIG. 1.
Figure 7:
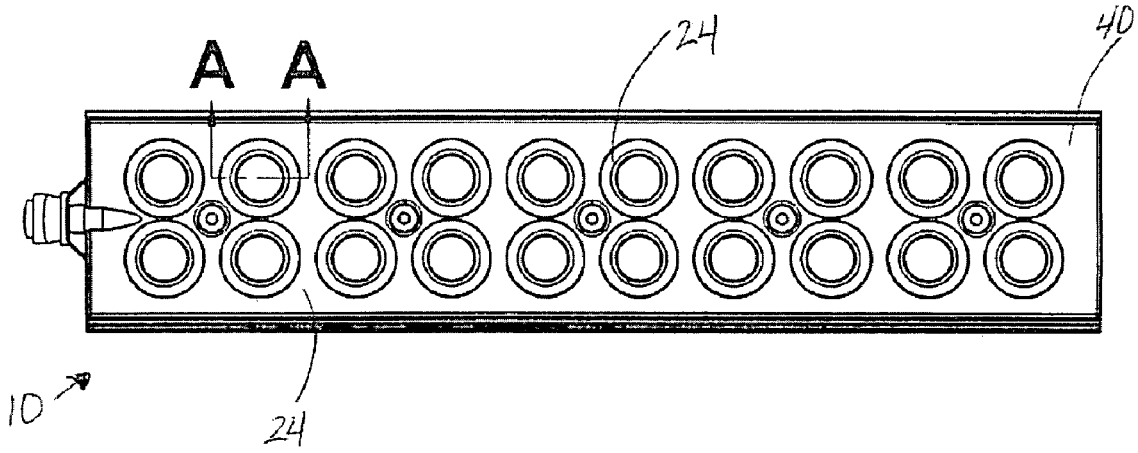
FIG. 7 is a top view of the lighting apparatus of FIG. 1.

A plurality of shield portions 26 of the shield-gasket member 24 are also present in certain embodiments as illustrated in FIG. 3. As shown in FIG. 10 shield portion 26 can be positioned partially over each primary-lens/secondary-lens-member pair 52 thereby to intercept a portion of the light path 22 emitted from the corresponding LED package 14. As shown in FIG. 8 shield portion 26 can have a substantially annular shape which causes shield portion 26 to intercept a portion of light path 22. Shield portion 26 in one embodiment has a substantially annular shape. The substantially annular shield portion 26 includes at least one gap 60 thereby to facilitate drainage of water as illustrated in FIG. 5. A plurality of substantially annular shield portions 26 include a plurality of gaps 60 which are oriented in the same direction to facilitate drainage of water or other liquid.

In certain embodiments, as illustrated in FIG. 10, shield portion 26 of shield-gasket member 24 has a reflective surface 44 facing secondary lens member 20. Another embodiment of the LED apparatus 10 is includes nomex layer 62 for electrical insulation purposes sandwiched between secondary lens member 20 and mounting hoard 12 as shown in FIG. 3.

A highly preferred embodiment of LED apparatus 10 includes aluminum layer 56 sandwiched between mounting board 12 and secondary lens member 20 as seen in FIG. 3. Another highly preferred embodiment includes both a nomex® layer 62 and aluminum layer 56, both layers being sandwiched between mounting board 12 and secondary lens member 20 (as illustrated in FIG. 3). (Nomex® is a flame resistant meta-aramid material.)

In some forms of such highly preferred embodiments having a plurality of LED packages on the mounting board, it is preferred to use a Flame Resistant 4 ("FR4") board formed by a conductor layer and an insulator layers. The conductor layer may be made of any suitable conductive material, preferably copper or aluminum 56. It is most highly preferred that such mounting board include, for each LED package thereon, a plurality of channels ("thermal vias") extending through the mounting board at positions beneath the package, such channels having therein conductive material and/or an opening to facilitate transfer of heat through the board. The thermal vias provide an isolated thermal path for each LED package.

In the forms of the present invention using the FR4 mounting board with thermal vias, it is most highly preferred that each LED package is constructed to have its cathode terminal electrically neutral from the thermal path. Thus, avoiding shortage of other LED packages on the board.

A wide variety of materials are available for the various parts discussed and illustrated herein. While the principles of this apparatus have been described in connection with specific embodiments, it should be understood clearly that these descriptions are made only by way of example and are not intended to limit the scope of the invention.

The invention claimed is:

1. In an LED apparatus for illumination toward a preferential side in a downward and outward direction including (a) a mounting board, (b) an LED package thereon with a primary lens having a central axis, and (c) a secondary lens member over the primary lens and establishing a light path therebetween, the improvement comprising an integrated shield-gasket member in the form of a layer positioned over the mounting board, LED package and secondary lens member, the shield-gasket member having a substantially annular-shaped shield portion with at least one gap thereby to facilitate drainage of water and a substantially planar gasket portion thereabout.

2. The LED apparatus of claim 1 wherein the shield member has a shield-member aperture aligned with the light path and the shield portion borders the shield-member aperture.

3. The LED apparatus of claim 1 wherein:

the secondary lens member includes a lens portion and a flange thereabout; and the shield portion may extend over a part of the lens portion of the secondary lens member.

4. The LED apparatus of claim 3 wherein the shield member has a shield-member aperture aligned with the light path and the shield portion borders the shield-member aperture.

5. The LED apparatus of claim 1 further including a cover securing the shield-gasket member with respect to the secondary lens member, the primary lens and the LED package.

6. The LED apparatus of claim 5 wherein the cover has an opening aligned with the light path.

7. The LED apparatus of claim 5 wherein the shield-gasket member is sandwiched between the cover and the flange of the secondary lens member.

8. The LED apparatus of claim 7 wherein the flange of the secondary lens member is against the mounting board.

9. The LED apparatus of claim 7 wherein the sandwiching is of the gasket portion of the shield-gasket member and of the flange of the secondary lens member when the cover is secured in place.

10. The LED apparatus of claim 1 comprising:

a plurality of LED packages spaced from one another on the mounting board;

a plurality of the secondary lens members, each secondary lens member positioned over the primary lens of a corresponding LED package, each primary-lens/secondary-lens-member pair establishing a light path and having a central axis;

a plurality of shield portions of the shield-gasket member, each shield portion is of a substantially annular shape and positioned partially over each primary-lens/secondary-lens-member pair thereby to intercept a portion of the light emitted from the corresponding LED package; and a gasket portion of the shield-gasket member, the gasket portion against the secondary lens member in position other than in the light path, the gasket portion yieldingly constraining the secondary lens member and accommodating secondary lens member movement caused by primary lens thermal expansion during operation.

11. The LED apparatus of claim 10 wherein for each shield portion of the shield-gasket member a shield-member aperture is aligned with the corresponding light path and the shield portion borders the shield-member aperture.

12. The LED apparatus of claim 10 wherein the plurality of substantially annular shield portions include a plurality of gaps oriented in the same direction thereby to facilitate drainage of water.

13. The LED apparatus of claim 10 wherein:

each secondary lens member includes a lens portion and a flange thereabout; and each shield portion may extend over a part of a corresponding lens portion.

14. The LED apparatus of claim 13 wherein for each shield portion of the shield member a shield-member aperture is aligned with the corresponding light path and the shield portion borders the shield-member aperture.

15. The LED apparatus of claim 10 further including a cover securing the shield-gasket member with respect to the secondary lens members, the primary lenses and the LED packages.

16. The LED apparatus of claim 15 wherein the cover has an opening aligned with the light path.

17. In an LED apparatus for illumination toward a preferential side in a downward and outward direction including (a) a mounting board, (b) an LED device thereon, and (c) a lens member having a central axis, the improvement comprising a shield-gasket member in the form of a layer positioned over the mounting board, LED device and lens member, the shield-gasket member having a substantially annular-shaped shield portion with at least one gap thereby to facilitate drainage of water and a substantially planar gasket portion thereabout.

18. In an LED apparatus for illumination toward a preferential side in a downward and outward direction including (a) a mounting board, (b) an LED device thereon, and (c) a lens member over the LED device and establishing a light path therebetween, the improvement comprising a shield-gasket member in the form of a layer positioned over the mounting board, LED device and lens member, the shield-gasket member having a substantially annular-shaped shield portion with at least one gap thereby to facilitate drainage of water and a substantially planar gasket portion thereabout.

19. The LED apparatus of claim 18 wherein:

the lens member includes a lens portion and a flange thereabout; and the shield portion may extend over a part of the lens portion of the lens member.

20. The LED apparatus of claim 18 further including a cover securing the shield member with respect to the lens member and LED device.

21. The LED apparatus of claim 18 comprising:

a plurality of LED devices spaced from one another on the mounting board;

a plurality of the lens members, each lens member positioned over the corresponding LED device, each lens member/LED device pair establishing a light path and having a central axis; and a plurality of shield portions of the shield-gasket member, each shield portion positioned partially over each lens member/LED device pair thereby to intercept a portion of the light emitted from the corresponding LED device; and a plurality of gasket portions of the shield-gasket member, each gasket portion in position other than in the light path of the corresponding LED device.

* * * * *